US007975934B2

(12) United States Patent
Young

(10) Patent No.: US 7,975,934 B2
(45) Date of Patent: Jul. 12, 2011

(54) RAIL INSULATORS

(75) Inventor: Hartley Frank Young, Melton (AU)

(73) Assignee: AirBoss Railway Products Inc., Kansas City, MO (US)

( * ) Notice: Subject to any disclaimer, the term of this patent is extended or adjusted under 35 U.S.C. 154(b) by 0 days.

(21) Appl. No.: 12/708,646

(22) Filed: Feb. 19, 2010

(65) Prior Publication Data

US 2010/0147967 A1 Jun. 17, 2010

Related U.S. Application Data

(63) Continuation of application No. 11/608,381, filed on Dec. 8, 2006, now abandoned.

(30) Foreign Application Priority Data

Dec. 15, 2005 (AU) ..... 2005907023

(51) Int. Cl.
*E01B 9/00* (2006.01)

(52) U.S. Cl. ..... 238/349; 238/351; 238/310

(58) Field of Classification Search ..... 238/352, 238/354, 343, 338, 315, 310, 265, 349, 351, 238/107

See application file for complete search history.

(56) References Cited

U.S. PATENT DOCUMENTS

| | | | |
|---|---|---|---|
| 4,267,970 | A | 5/1981 | Lubbers |
| 4,576,334 | A | 3/1986 | Young |
| 4,928,878 | A | 5/1990 | Young |
| 5,110,046 | A | 5/1992 | Young et al. |
| 5,520,330 | A | 5/1996 | Brown et al. |
| 5,551,633 | A | 9/1996 | Kish et al. |
| 6,367,704 | B1 | 4/2002 | Mediavilla |
| 6,604,690 | B2 | 8/2003 | Young et al. |
| 2002/0000475 | A1 | 1/2002 | Igwemezie |

FOREIGN PATENT DOCUMENTS

| | | |
|---|---|---|
| WO | WO-0231264 | 4/2002 |

*Primary Examiner* — Mark T Le
(74) *Attorney, Agent, or Firm* — Connolly Bove Lodge & Hutz LLP

(57) ABSTRACT

A rail support assembly includes a rail tie, a rail with a rail base, a pair of support shoulders embedded in the rail tie and located on either side of the rail base, rail clips seated in the support shoulders and having a toe section lying on the rail base, rail insulators having an upper portion lying between the clip toes and the rail base, abutting the rail base, and a lower portion wedged between the rail base and the support shoulders, wherein each support shoulder includes: a rail face; a clip gateway through the rail face; a rail clip ramp from the rear of the shoulder to the clip gateway; and a retention ledge formed on the rail face on each side of the clip gateway. When assembled, each retention ledge is disposed above one of the rail insulators to prevent vertical movement of the respective rail insulators.

2 Claims, 7 Drawing Sheets

RAIL INSULATORS

RELATED APPLICATIONS

This application is a continuation of application Ser. No. 11/608,381, filed on Dec. 8, 2006, now abandoned and for which priority is claimed under 35 U.S.C. §120; and this application claims priority of Application No. 2005907023 filed in Australia on Dec. 15, 2005 under 35 U.S.C. §119; the entire contents of all are hereby incorporated by reference.

TECHNICAL FIELD

This invention relates to a rail fastening assembly of the type where a rail is clamped to a rail seat by elastic rail fasteners held in shoulders fastened to the tie and insulators isolate the rail fastener and support shoulders from the rail. The present invention addresses problems associated with the insulators.

BACKGROUND

Concrete ties have been in use in some parts of the world for a long time but it is only since 1985 that they have been able to provide cost benefits for use in North America relative to wooden ties.

One advantage of concrete ties is that the rail seats can be pre assembled with only a few components to be added on site when the rail is placed in position. The difficulty with this is that the pre assembled components can become dislodged during transport and some components still have to be positioned on the rail. The rail seats usually comprises a rail pad that is positioned below the rail, an abrasion resistant plate below the pad, rail clip support shoulders on the field and gauge sides of the rail, an elastic rail clip that seats in the support shoulder and bears down on the rail base and an insulator that lies between the rail and the rail clip and the support shoulder. The support shoulders are precast in the rail tie and the rail pad is fitted between each pair. Because the rail clips and insulators contact the rail when fastened they cannot be placed in position until the rail has been placed in position on the rail seat. Rail seat assemblies of this type have been generally described in U.S. Pat. Nos. 5,110,046, 5,551,633 and 6,604,690. The rail clips in these assemblies are either installed or loose and therefore had to be assembled on site. U.S. Pat. No. 6,367,704 proposed using a modified support shoulder so that the clip could be partially installed for transport purposes where it was retained on the shoulder and then able to be fully installed when the rail was placed in position. In this arrangement the insulators still needed to be placed in position manually before the clip could be fully installed. The insulator is a one piece assembled part that lies on the rail flange to separate the rail from the clip and extends down between the rail flange and the support shoulder to provide insulation between the shoulder and the rail.

U.S. Pat. No. 5,520,330 discloses a bent rod rail clip with a two part insulator that enables the rail seat to be pre-assembled at the tie plant.

WO02/31264 discloses a rail clip that has an insulator encapsulating the toe of the rail clip that lies on the rail flange to avoid the need to insert the insulator separately.

It is an object of this invention to provide a rail clip insulator that enables easier assembly of a rail seat without compromising rail fastening performance.

SUMMARY OF THE INVENTION

To this end the present invention provides a railroad tie and rail seat assembly for supporting a rail which includes a) a concrete rail tie b) a pair of rail clip support shoulders cast in place in said rail tie each said shoulder having a rail face between its external sides, a clip gateway through said rail face, a rail clip ramp leading from the rear of the shoulder and terminating in the clip gateway at substantially the level of the rail base and an external vertical retention rib on each side of the shoulder and optionally, an insulator location flange on the rail face adjacent the gate;

c) a rail pad seated on said rail tie between said support shoulders d) a pair of shoulder insulators each shaped to lie against the rail face of the rail shoulder level with the gate and abutting the location flange and incorporating side arms that clip over the external retention rib of the shoulders;

e) a pair of rail clips each having a base section adapted to seat within the rail clip support shoulder and a toe section adapted to seat on the rail base, the toe section comprising a pair of bifurcated arms extending from said base section and being bent in a curve so that the toes lie adjacent but beyond the base f) a pair of toe insulators each adapted to fit about the toe of the rail clip to insulate the clip from the rail base g) the arrangement being such that when the rail clip has a first stable position in the shoulder the toe insulator where the toe of the clip sits does not project beyond the face of the shoulder insulator so that a rail can be laid between the rail shoulders and their associated insulators and a second stable position where the toe insulator and the toes of the rail clip lie on the rail base.

This arrangement enables the rail seat to be preassembled in such a way that all the components are held in place on the tie during transport from the tie production plant to the railway installation site. Once the rail is placed in position on the tie, the clips are simply pushed onto the rail base to secure the rail. In the preloaded, transport position the base of the clip is only partially inserted into the clip recess of the support shoulder. This is made possible by replacing the conventional rail insulator with two insulators one being attachable to the support shoulder to insulate the shoulder from the rail and the other being attachable to the rail clip to insulate the clip from the rail.

The shoulder insulator encloses the rail face of the support shoulder and provides insulation between the rail base and the support shoulder in a direction substantially normal to the rail tie. The shoulder insulator has side arms extending along the sides of the shoulder which are resiliently biased against the sides of the support shoulder to locate and retain the shoulder insulator on the shoulder. The shoulder insulator also includes a gate similar in shape to the shoulder gate for the rail clip and toe insulator to pass through. The top of the shoulder insulator is abutted by the front of the toe insulator to prevent it being lost during transport when the rail clip is not fully loaded. The portion of the shoulder insulator on either side of the gate may abut an optional location flange that limits any vertical movement of the insulator during heavy load conditions. It is also important that the shoulder insulator is dimensioned to enable it to be removed and replaced during track maintenance if the clip and toe insulator are retracted to lie in the shoulder gate.

The toe insulator functions like a sled and the forward wall is radiussed to enable the insulator to ride over the leading edge of the rail base and up the inclined surface of the rail base. The toe insulator incorporates a recess for each toe portion with sufficient room to enable the bifurcated arms to be squeezed together as they pass through the guideway of the shoulder. The toe insulator is dimensioned relative to the support shoulder so that in the preload position the toe insulator does not project beyond the rail face of the support shoulder any further than the post insulator so that the rail can be placed onto the rail seat without disturbing the prefitted components. Once the rail is in place the clips and the associated toe insulators can be pushed on to the rail base to the fully loaded or installed position. A preferred toe insulator is disclosed in copending application PCT/AU2004/001280.

When the clip and toe insulator are in the fully loaded position the rear end of the insulator preferably remains within the gateway of both the shoulder and the shoulder insulator, so that any axial movement of the rail will cause the toe insulator to contact the sides of the shoulder and shoulder insulator gates and consequently provide a creep resisting force. Without this resistance the sideward creep force would be resisted by the clip which is flexible in that direction and the available creep resisting force provided by the clip is lower than that provided by the shoulder which is rigidly fixed to the rail tie. The shoulder insulator is rigidly attached to the shoulder so that sideways force applied to this insulator is transmitted directly to the shoulder. This feature of the clip and toe insulator increases resistance of the total assembly to the effects of rail creep.

While this invention is primarily aimed at providing benefits for original track installations it also gives ongoing benefits for track maintenance. When the rail and pads need to be changed it is a simple matter to move the clip and toe insulator back into the first stable position for removal of the rail & then to press the clip and toe assemblies back into the second stable position on the rail base when the replacement is complete.

If only the shoulder insulator needs to be removed it is able to be removed by twisting the shoulder insulator so that the side arms are swiveled clear of the retention rib and the locating flange so that the insulator can then be pulled clear of the shoulder.

This invention is also applicable to single piece insulators that do away with the need for a toe insulator by providing a portion that lies on the rail base.

In another aspect this invention is concerned with damage to insulators particularly one piece insulators caused by the movement of the insulator in curved sections of track. Where the support shoulders are much wider than the toe of the clip only a small central portion of the insulator is under vertical downward pressure while the portion of the insulator lying between the shoulder and the rail may be squeezed and pushed upwardly resulting in a banana effect on the insulator. To inhibit this behaviour, upstops are provided on the support shoulder to engage the outer portions of the insulator to inhibit the bending of the insulators. These stops need only be provided on the field side of the rail seat.

DETAILED DESCRIPTION OF THE INVENTION

Preferred embodiments of the invention will now be described with reference to the drawings in which FIG. 1 is a side view of a rail seat assembly of this invention;

Figure 1:
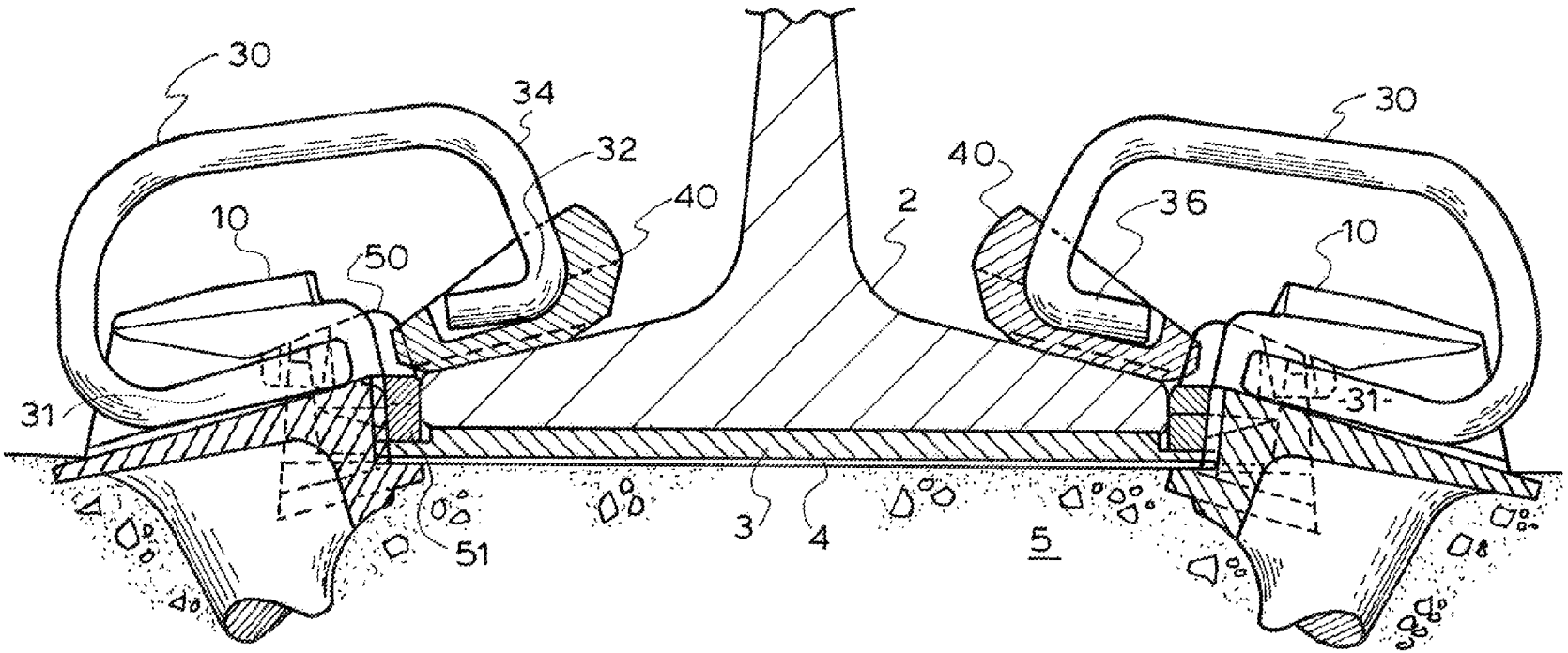
Figure 2:
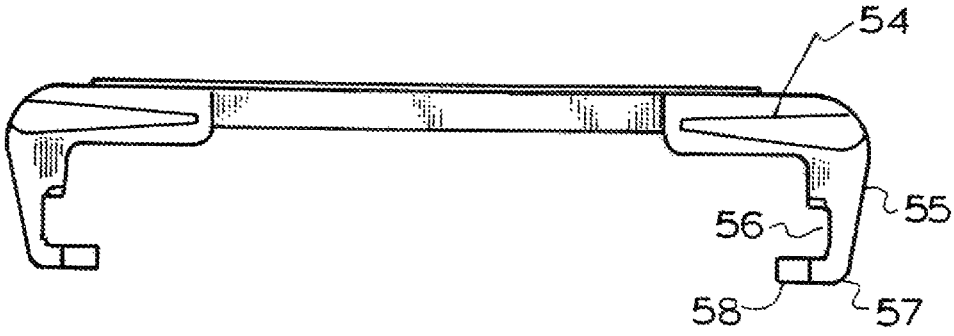
FIG. 2 is a plan view of one embodiment of the shoulder insulator of this invention.
Figure 3:
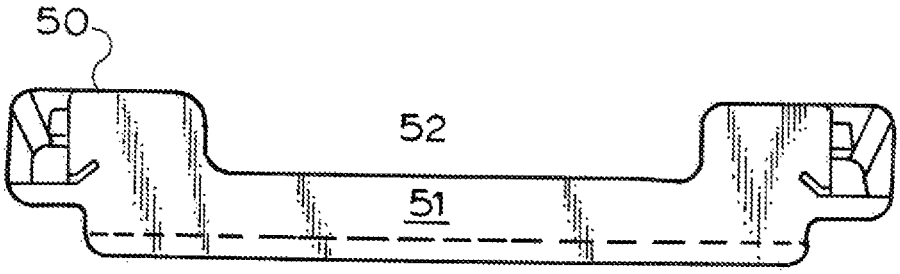
FIG. 3 is a front view from the rail of the shoulder insulator of FIG. 4.
Figure 4:
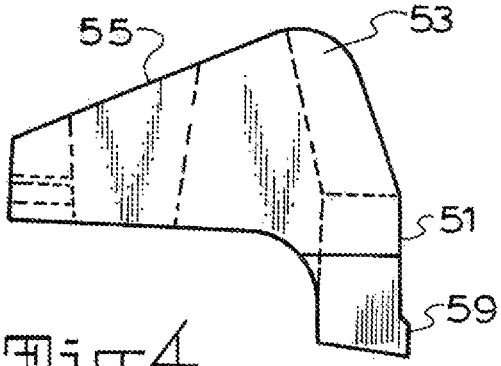
FIG. 4 is a side view of the shoulder insulator of FIG. 4.
Figure 5:
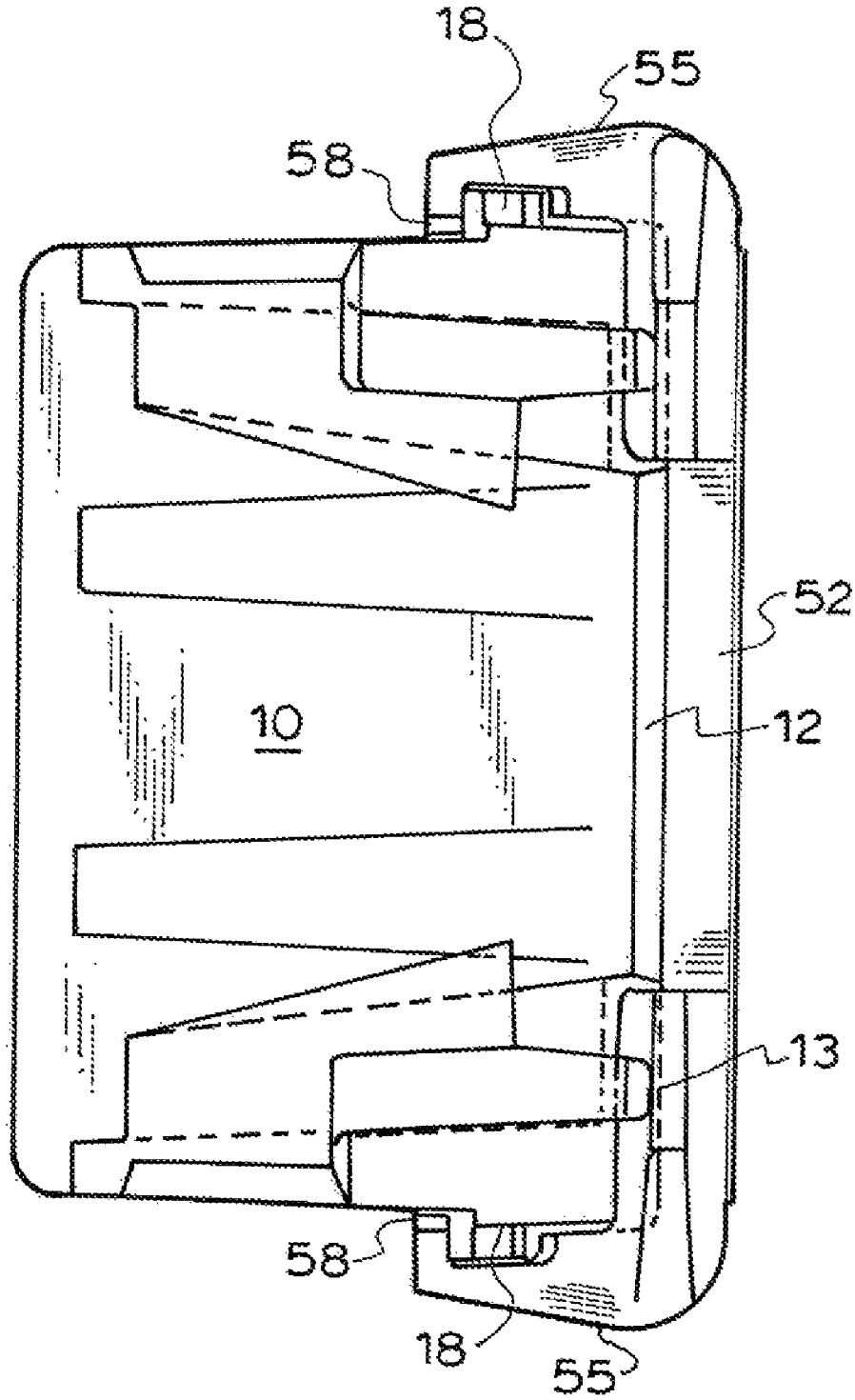
FIG. 5 is a plan view of the shoulder insulator attached to a shoulder.

The rail seat comprises a concrete rail tie 5 into which has been cast the rail clip support shoulders 10. Between the two shoulders 10 are positioned a rail pad 3 and beneath that a wear resisting plate 4. The rail 2 seats on the rail pad 3. This rail pad may incorporate a recess at its edge adjacent the shoulder 10 to accommodate a deep post insulator 50. The rail pad is preferably as described in Australian specification 2004201448. The base 31 of rail clip 30 is securely held within the shoulder 10 and the toe section 32 seats within the toe insulator 40 that lies on the rail base 2. The deep post insulator 50 is attached to shoulder 10 and lies between the rail base 2 and the shoulder 10 and extends down to the rail pad 3.

The rail clip 30 as illustrated in FIG. 1 is made from a flat metal stamping bent into its final 3 dimensional state. The rail clip consists of a base web 31 which bifurcates into arms 34 that end in the toe portions 32. The ends 36 of the toe portion 32 are shaped to enable to clips to be held in a partially applied position in the shoulder 10. The rail clip and shoulder are designed so that the clip has two stable positions in the shoulder namely a preloaded position where a rail can be placed in position on the rail seat and a fully loaded position in which the toes of the rail clip are on the rail base.

The toe insulator 40 shown in FIG. 1 is conceptually like a sled encompassing the toe portion 32 of clip 30. The toes 32 of the clip enter the toe insulator 40 vertically and provide a downward force on the insulator 40. The insulator 40 has a front wall with sides shaped to pass through the gate 12 of the shoulder 10 and the gate 52 of the shoulder insulator 50. The lower front wall of the toe insulator is angled to assist the insulator to ride up the rail base 2 particularly when the tie is lower than the final position. The lower surface of the toe insulator is flat to provide maximum contact area with the rail base 2. The rear of the base of the toe insulator is upwardly inclined to assist in the movement of the insulator. The toes 32 of the clip, seat in the toe recesses formed by the centre web that extends between the front wall and the rear wall of the toe insulator. This web reinforces the toe insulator and strengthens the front and rear walls to ensure that the insulator 40 can withstand the forces applied during installation of the clip onto the rail base. As the clip is moved forward the insulator 40 is pushed forward by the radiussed portion of the clip toe 32 abutting the forward wall of the toe insulator. And when the clip 30 is retracted the free end of the toe 32 abuts the rear wall and the insulator 40 moves rearwardly with the clip 30.

Figure 6:
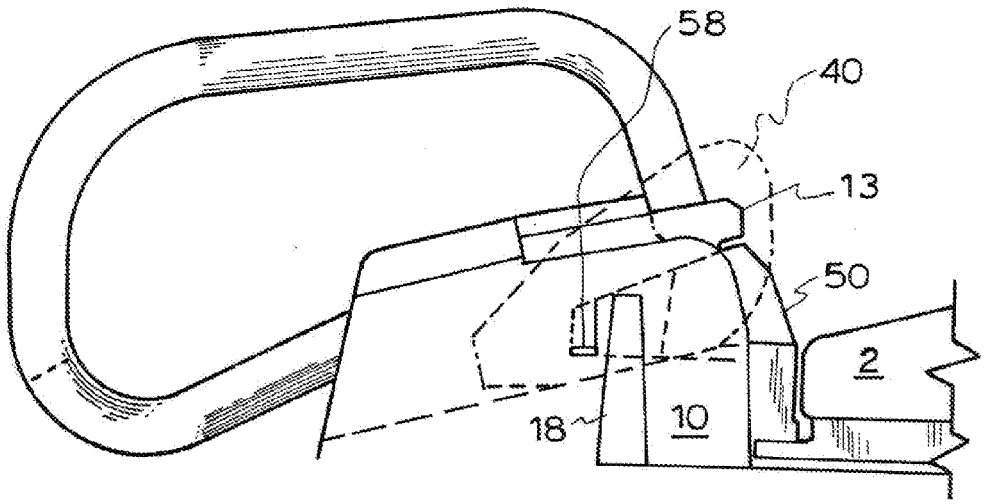
FIG. 6 is a side view of the shoulder insulator in position on a shoulder.

The two part insulator in combination with the clip and shoulder of this invention enables the rail seat to be preassembled at the concrete tie plant as shown in FIG. 6. The clip is in the preloaded position and the insulator 40 is locked in by the toes 32 and the insulator 50 is attached to the rail face of shoulder 10. The base 31 of the clip has entered the clip slot in the shoulder 10. In this preassembled position the rail tie can be transported without the risk of components being lost. On site once the tie is in position the rail can be moved into position and the only installation step needed is to push the clip toward the rail which takes the toe portion 32 of the clip and insulator 40 onto the rail base and the base of the clip 31 seats in its loaded position in shoulder 10 to secure the clip in place.

The angled base of the installed shoulder and the angle of the clip base in the shoulder are chosen so that the frictional engagement of the clip base keeps the clip located on the rail base.

The shoulder insulator 50 has a rail face 51 which abuts the rail base 2 and has a gate 52 matching the shoulder gate 12. The corner pieces 53 on either side of the gate incorporate a chamfered surface 54 that guides the rail into position. The arms 55 are resiliently biased against the sides of the support shoulder and are shaped to fit around the corners of the shoulder 10 and the recess 56 fits over the vertical rib 18 to locate and retain the insulator in position. When the shoulder 10 is cast into the concrete tie the rib 18 is inclined to the vertical so that it wedges against the end 57 of the arm 55 to provide a snug fit. A thin upturned flap 58 is provided on the end 57 to act as a ratchet on the rough surface of the cast metal shoulder 10 to ensure that the shoulder insulator 50 is retained in place. This retention system also ensures that the shoulder insulator is retained in place when the rail tie is transported partly assembled from the tie plant. A ledge 59 is provided on the lower edge of the face 51 to engage the bottom edge of the rail base 2 and resist upward movement of the insulator. The corner pieces 53 lie under the up stops 13 on shoulder 10 to prevent vertical movement or banana flexing of the shoulder insulator 50. As can be seen in FIG. 6, in the assembled position, the up stops 13 extend horizontally from the rail face of the shoulder 10 to above the shoulder insulator 50, to thereby prevent vertical movement of the shoulder insulator.

Figure 7:
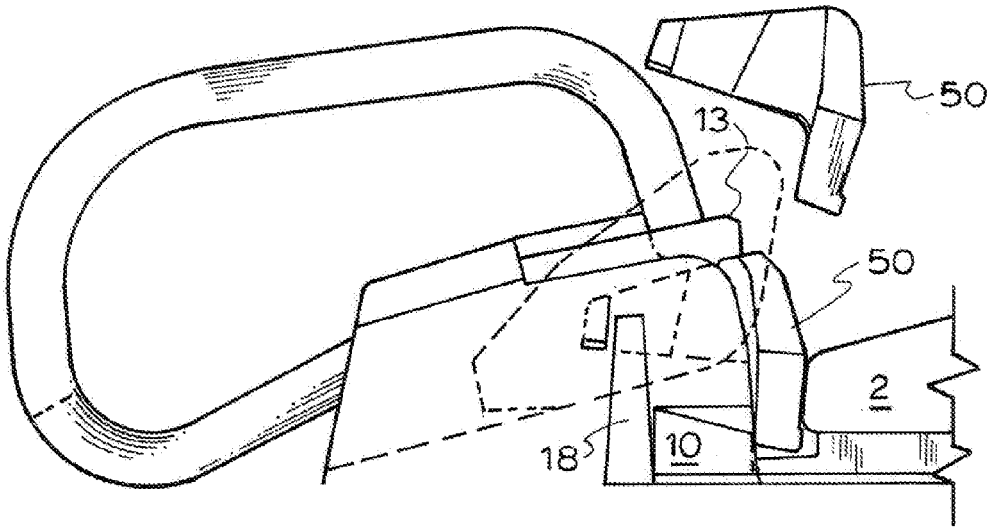
FIG. 7 illustrates the removal or fitting of the shoulder insulator.
Figure 8:
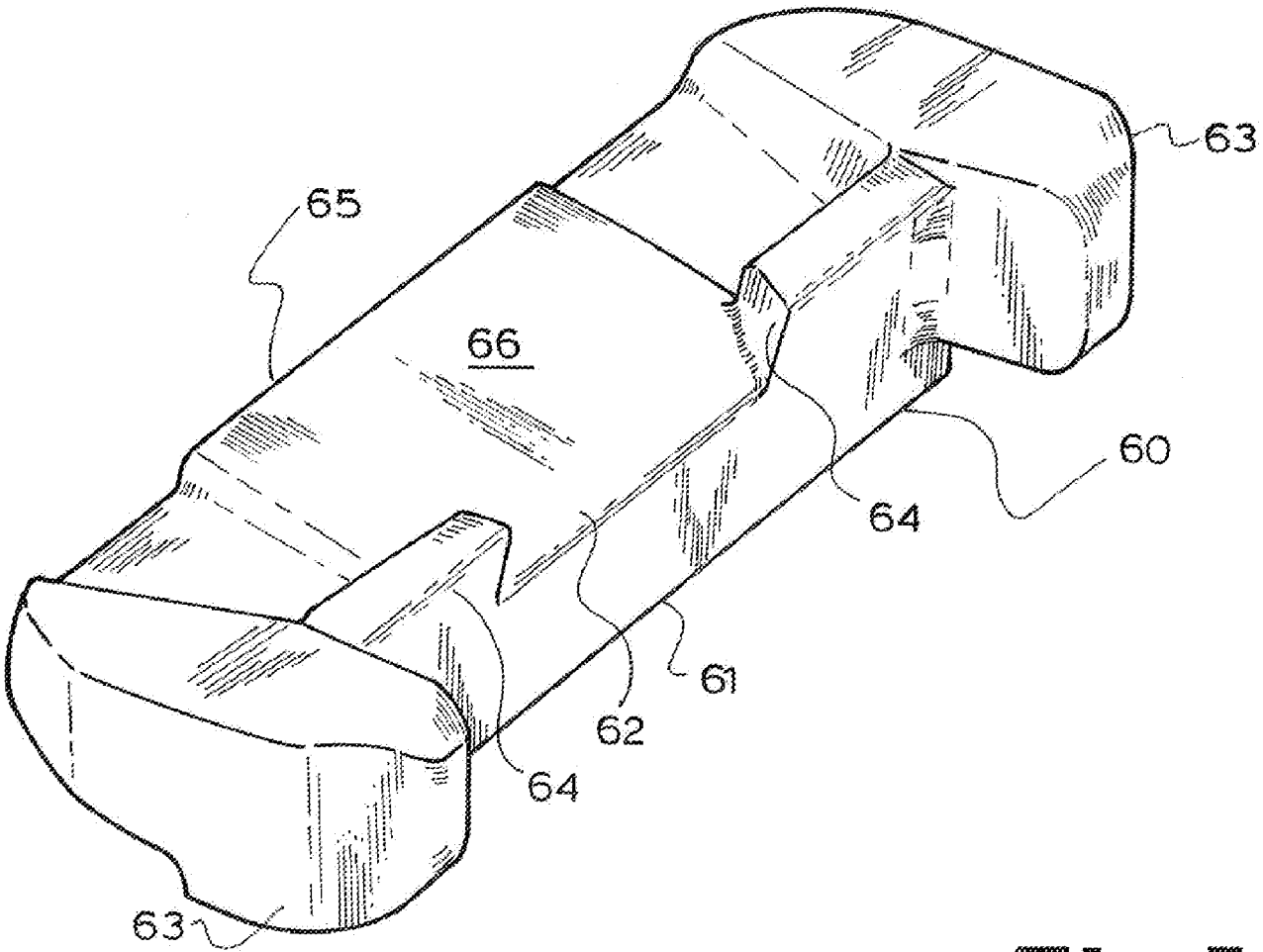
FIG. 8 illustrates a one piece rail and shoulder insulator used in a second aspect of the invention.
Figure 9:
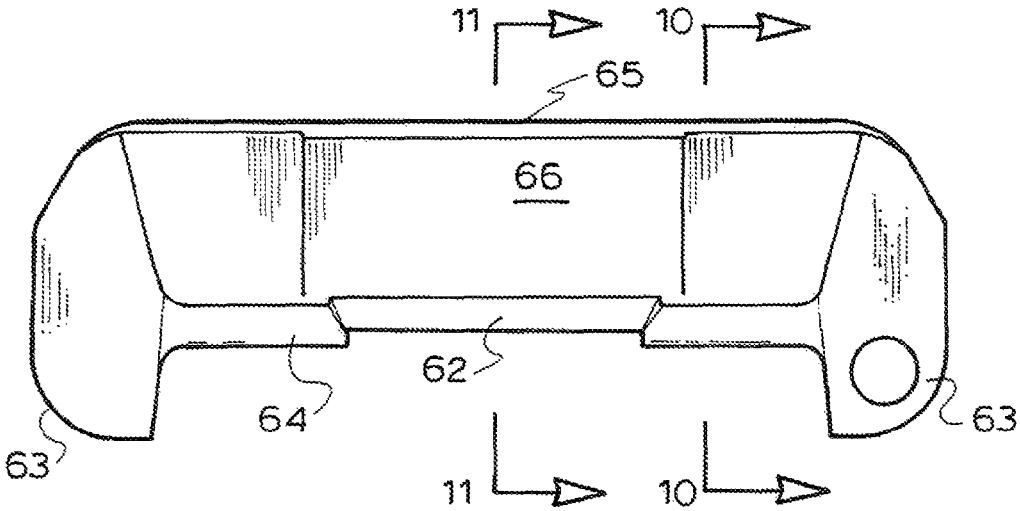
FIG. 9 is a plan view of the insulator of FIG. 8.
Figure 10:
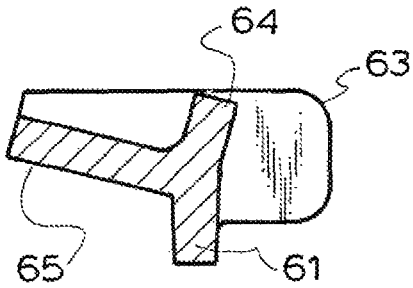
FIG. 10 is a sectional view 10-10 of FIG. 9.
Figure 11:
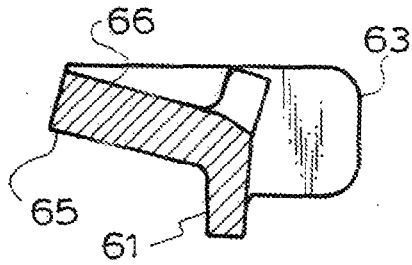
FIG. 11 is a sectional view 11-11 of FIG. 9.
Figure 12:
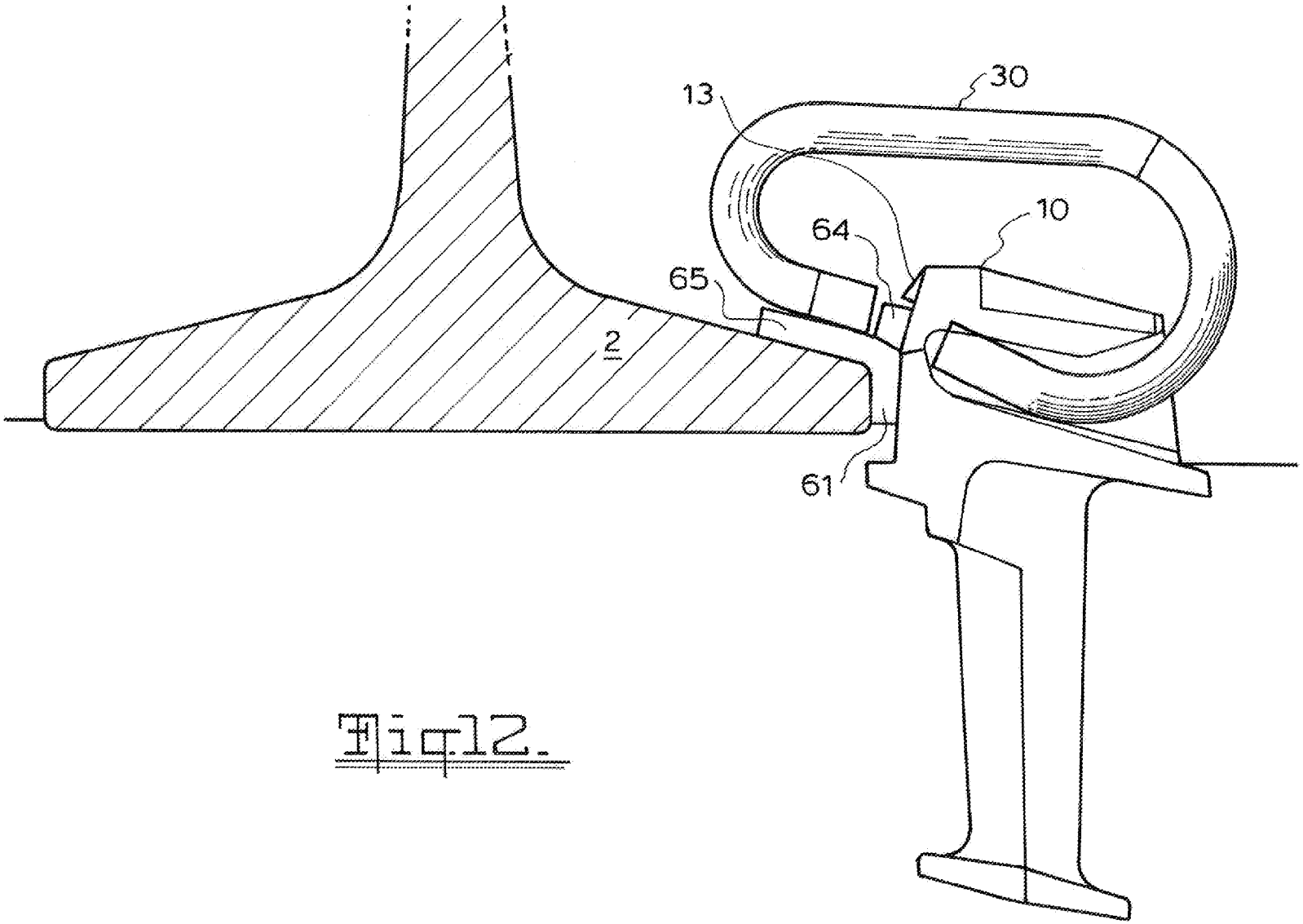
FIG. 12 illustrates the one piece insulator of FIG. 8 installed with a shoulder of this invention.

The shoulder insulator is removed as shown in FIG. 7 by inclining it toward the rail and then withdrawing so that the ledge 59 clears the rail base edge and the corner pieces clear the upstops 13 and the arms 55 are tilted so that the ends 57 clear the top of the vertical retention ribs 18 and the post clears the front of the toe insulator 40. The shoulder insulator can be inserted in reverse sequence. The shoulder insulator can be fitted and removed by hand or with the use of a tool that grips the side arms 55 and then twists and flexes the insulator 50 so that it clears the rail base, retention rib 18, toe insulator 40 and location flange 13. The one piece insulator 60 shown in FIG. 9 comprises the shoulder insulator portion 61 which lies between the rail and the support shoulder; the rail insulator portion 65 which lies on the rail base; and the corner pieces 63 which enclose the corners of the shoulder 10. The gate 62 lies between the gate ribs 64 and coincides with the gate 12 of the shoulder 10. The gate ribs 64 abut the up stops 13 of the shoulder to prevent bending of the insulator particularly on the field side of the rail seat. The rail portion 65 incorporates the central bearing surface 66 on which the toes of the rail clip apply a downward force.

With the one piece insulator 60 the rib 18 and the attachment arms on the insulator are not needed because the rail clip holds the insulator 60 in position relative to the shoulder 10. The upstops 13 stabilize the position of the insulator 60 by abutting the gate ribs 64.

Those skilled in the art will realize that the present invention provides a rail tie assembly that is easy to fabricate and assemble and reduces the time and cost of installation. Although two particular embodiments have been described those skilled in the art will realize that variations and modifications may be made without departing from the core teachings of the invention.

The invention claimed is:

1. A railroad rail support assembly comprising:

a concrete rail tie;

a rail which includes a rail base;

a pair of support shoulders embedded in the concrete rail tie and located on either side of the rail base;

rail clips having a base section adapted to seat in said support shoulders and a toe section adapted to lie on the base of said rail;

rail insulators that include an upper portion that lies between the clip toes and the rail base, abutting the rail base; and a second lower portion wedged between a lateral edge of the rail base and the support shoulders, wherein each support shoulder has a rail face between external sides thereof;

a clip gateway through said rail face;

a rail clip ramp leading from the rear of the shoulder and terminating in the clip gateway at substantially the level of the top of the rail base; and an external horizontal retention ledge formed on the rail face on each side of the clip gateway, each external horizontal retention ledge being disposed above a respective one of the rail insulators, when the support assembly is in the assembled position, to prevent vertical movement of the respective one of the rail insulators.

2. A support shoulder as claimed in claim 1, which includes an external vertical insulator retention rib on each external side.

* * * * *